US007240651B1

(12) United States Patent
Hanshaw

(10) Patent No.: US 7,240,651 B1
(45) Date of Patent: Jul. 10, 2007

(54) VARIABLE CAM TIMING DAMPER

(75) Inventor: Jamie Hanshaw, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/395,484

(22) Filed: Mar. 30, 2006

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31; 92/120–125; 91/399–410
See application file for complete search history.

(56) References Cited

U.S. PATENT DOCUMENTS

| | | | | |
|---|---|---|---|---|
| 5,002,023 | A | 3/1991 | Butterfield et al. | |
| 5,107,804 | A | 4/1992 | Becker et al. | |
| 5,172,659 | A | 12/1992 | Butterfield et al. | |
| 5,184,578 | A | 2/1993 | Quinn, Jr. et al. | |
| 5,361,735 | A | 11/1994 | Butterfield et al. | |
| 5,386,807 | A | 2/1995 | Linder | |
| 5,497,738 | A | 3/1996 | Siemon et al. | |
| 5,657,725 | A | 8/1997 | Butterfield et al. | |
| 6,053,138 | A | 4/2000 | Trzmiel et al. | |
| 6,085,708 | A | 7/2000 | Trzmiel et al. | |
| 6,276,321 | B1 | 8/2001 | Lichti et al. | |
| 6,453,859 | B1 | 9/2002 | Smith et al. | |
| 6,591,799 | B1 | 7/2003 | Hase et al. | |
| 6,742,486 | B2 * | 6/2004 | Palesch et al. | 123/90.17 |
| 6,763,791 | B2 | 7/2004 | Gardner et al. | |
| 6,766,777 | B2 | 7/2004 | Simpson et al. | |
| 6,799,544 | B1 * | 10/2004 | Pierik | 123/90.17 |

* cited by examiner

*Primary Examiner*—Thomas Denion
*Assistant Examiner*—Zelalem Eshete
(74) *Attorney, Agent, or Firm*—Allan J. Lippa; Alleman Hall McCoy Russell & Tuttle LLP

(57) ABSTRACT

A variable cam-timing phaser, including a stator having a plurality of inwardly-extending stator lobes and a rotor having a plurality of outwardly-extending rotor lobes. The rotor is rotatably disposed within the stator so that the rotor lobes interleave with the stator lobes to form a first timing chamber and a second timing chamber between each of the stator lobes. The phaser further includes a hydraulic valve, where the phaser is configured so that, upon operation of the valve to selectively couple the second timing chambers to a hydraulic fluid supply and the first timing chambers to a hydraulic fluid sink, the rotor is caused to rotate toward a terminal position, in which at least one of the first timing chambers is at least partially sealed off from the hydraulic fluid sink, thereby producing a tendency toward pressure equalization between the first timing chambers and the second timing chambers.

18 Claims, 6 Drawing Sheets

VARIABLE CAM TIMING DAMPER

BACKGROUND AND SUMMARY

There are many advantages to variable valve timing, including improved efficiency, power and emissions. In cam-based engines, variable valve timing is commonly achieved by varying the relative angle between the crankshaft and camshaft. Hydraulically-actuated cam phasers may be used to provide the variation in the relative angle.

In such cam phaser devices, a plurality of advance chambers and retard chambers are defined between a rotor and a stator. The rotor is coupled to the camshaft, and the stator is coupled to the crankshaft via a timing belt or chain. A hydraulic valve system is employed to control relative hydraulic pressure between the advance and retard chambers. To advance cam timing, hydraulic pressure is increased in the advance chambers relative to the retard chambers, thereby producing a relative rotation between the rotor and stator. Conversely, timing is retarded by increasing pressure in the retard chambers relative to the advance chambers. A given timing is maintained by keeping the pressures within the advance and retard chambers substantially equal.

While providing effective variable valve operation, many cam timing phasers produce significant noise. For example, when maximum retarded or maximum advanced timing is commanded, the hydraulic forces can cause the rotor to impact the stator at a significant velocity. In addition, when the rotor is close to the stator (e.g., nearly fully advanced or retarded), cam torsional effects can cause the rotor to forcefully impact the stator. This can result in noise, vibration and harshness (NVH) levels high enough to cause operator dissatisfaction.

Accordingly, the present description provides for variable cam timing phaser having a stator and a rotor. The stator has a plurality of inwardly-extending stator lobes, and the rotor has a plurality of outwardly-extending rotor lobes. The rotor is rotatably disposed within the stator so that the rotor lobes interleave with the stator lobes to form a first timing chamber and a second timing chamber between each of the stator lobes.

According to one example, the phaser further includes a valve, and where upon operation of the valve to selectively couple the second timing chambers to a hydraulic fluid supply and the first timing chambers to a hydraulic fluid sink, the rotor is caused to rotate toward a terminal position, in which at least one of the first timing chambers is at least partially sealed off from the hydraulic fluid sink, thereby producing a tendency toward pressure equalization between the first timing chambers and the second timing chambers.

According to another example, the phaser further has a plurality of hydraulic fluid orifices. One such orifice is associated with each of the first timing chambers for permitting hydraulic fluid to fill and drain from each of the first timing chambers. The orifices are positioned so that when the stator and rotor are in a first relative rotational position, each of the orifices is fluidly coupled with its associated first timing chamber. When the stator and rotor are in a second relative rotational position, at least one of the orifices is sealed off from its associated first timing chamber.

In certain settings, the exemplary embodiments described herein provide the advantages of variable cam timing, while minimizing or eliminating the undesirable NVH levels produced by prior variable cam timing systems.

DETAILED DESCRIPTION

Figure 1:
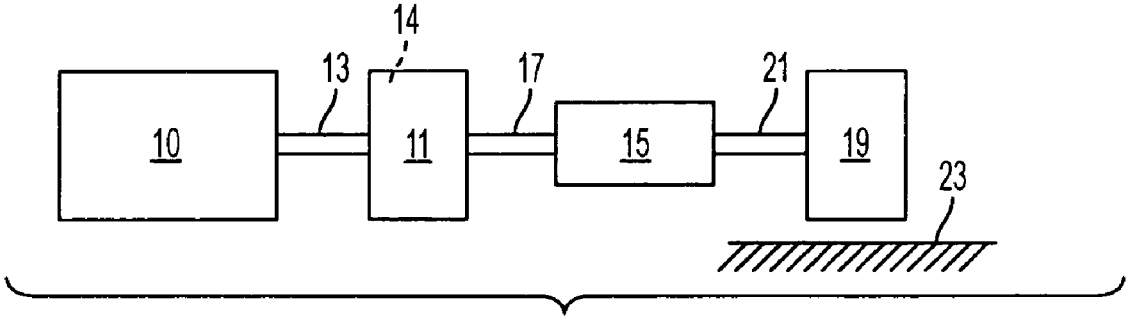
FIG. 1 depicts an engine and other components of a vehicle powertrain according to the present description.
Figure 2:
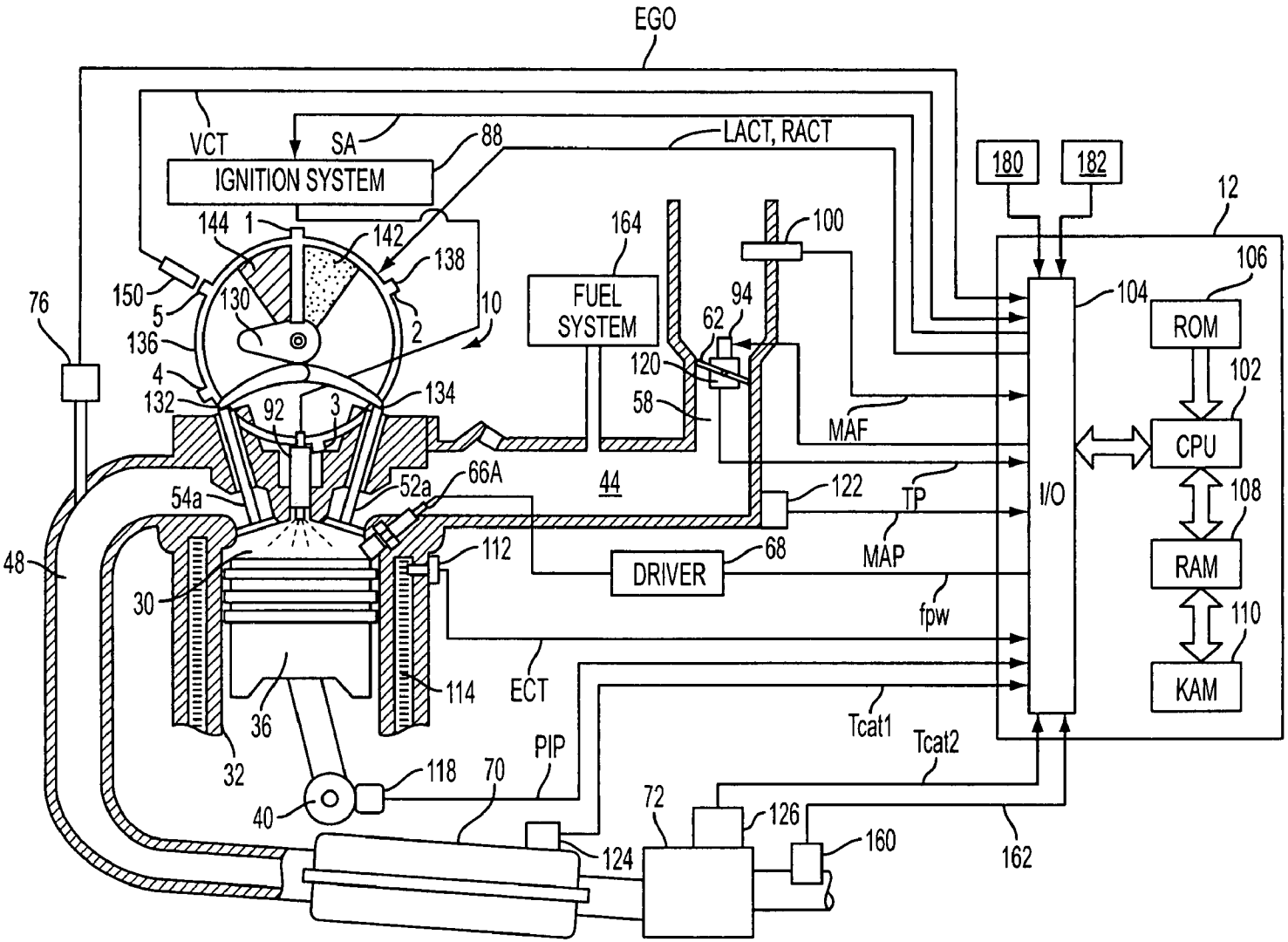
FIG. 2 shows a partial engine view.

Referring first to FIG. 1, internal combustion engine 10, further described herein with reference to FIG. 2, is shown coupled to torque converter 11 via crankshaft 13. Torque converter 11 is also coupled to transmission 15 via turbine shaft 17. Torque converter 11 has a bypass, or lock-up clutch 14 which can be engaged, disengaged, or partially engaged. When the clutch is either disengaged or partially engaged, the torque converter is said to be in an unlocked state. The lock-up clutch 14 can be actuated electrically, hydraulically, or electro-hydraulically, for example. The lock-up clutch 14 receives a control signal (not shown) from the controller, described in more detail below. The control signal may be a pulse width modulated signal to engage, partially engage, and disengage, the clutch based on engine, vehicle, and/or transmission operating conditions. Turbine shaft 17 is also known as transmission input shaft. Transmission 15 comprises an electronically controlled transmission with a plurality of selectable discrete gear ratios. Transmission 15 also comprises various other gears, such as, for example, a final drive ratio (not shown). Transmission 15 is also coupled to tire 19 via axle 21. Tire 19 interfaces the vehicle (not shown) to the road 23. Note that in one example embodiment, this powertrain is coupled in a passenger vehicle that travels on the road.

FIG. 2 shows one cylinder of a multi-cylinder engine, as well as the intake and exhaust path connected to that cylinder. Continuing with the figure, exemplary engine 10 employs direct injection, and includes a plurality of combustion chambers. Various aspects of engine operation are controlled by electronic engine controller 12. Combustion chamber 30 of engine 10 is shown including combustion chamber walls 32 with piston 36 positioned therein and connected to crankshaft 40. A starter motor (not shown) is coupled to crankshaft 40 via a flywheel (not shown). In this particular example, piston 36 includes a recess or bowl (not shown) to help in forming stratified charges of air and fuel. Combustion chamber, or cylinder, 30 is shown communicating with intake manifold 44 and exhaust manifold 48 via respective intake valves 52*a* and 52*b* (not shown), and exhaust valves 54*a* and 54*b* (not shown). Fuel injector 66A is shown directly coupled to combustion chamber 30 for delivering injected fuel directly therein in proportion to the pulse width of signal fpw received from controller 12 via conventional electronic driver 68. Fuel is delivered to fuel injector 66A by a conventional high pressure fuel system (not shown) including a fuel tank, fuel pumps, and a fuel rail. In other exemplary embodiments, port injection (e.g., into intake manifold 44) may be employed in addition to or instead of the depicted direct injection configuration.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas sensor 76 is shown coupled to exhaust manifold 48 upstream of catalytic converter 70. Note that sensor 76 may correspond to various different sensors and sensor types, depending on the particular exhaust configuration. Sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12. Though spark ignition components are shown, engine 10 (or a portion of the cylinders thereof) may be operated in a compression ignition mode, with or without spark assist.

Controller 12 may be configured to cause combustion chamber 30 to operate in either a homogeneous air/fuel mode or a stratified air/fuel mode by controlling injection timing. In the stratified mode, controller 12 activates fuel injector 66A during the engine compression stroke so that fuel is sprayed directly into the bowl of piston 36. Stratified air/fuel layers are thereby formed. The strata closest to the spark plug contain a stoichiometric mixture or a mixture slightly rich of stoichiometry, and subsequent strata contain progressively leaner mixtures. During the homogeneous spark-ignition mode, controller 12 activates fuel injector 66A during the intake stroke so that a substantially homogeneous air/fuel mixture is formed when ignition power is supplied to spark plug 92 by ignition system 88. Controller 12 controls the amount of fuel delivered by fuel injector 66A so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel ratio being a function of the amount of fuel delivered to combustion chamber 30. An additional split mode of operation wherein additional fuel is injected during the exhaust stroke while operating in the stratified mode, is also possible.

Nitrogen oxide (NOx) adsorbent or trap 72 is shown positioned downstream of catalytic converter 70. NOx trap 72 is a three-way catalyst that adsorbs NOx when engine 10 is operating lean of stoichiometry. The adsorbed NOx is subsequently reacted with HC and CO and catalyzed when controller 12 causes engine 10 to operate in either a rich homogeneous mode or a near stoichiometric homogeneous mode such operation occurs during a NOx purge cycle when it is desired to purge stored NOx from NOx trap 72, or during a vapor purge cycle to recover fuel vapors from the fuel tank. For example, fuel system 164 is also shown in schematic form delivering vapors to intake manifold 44. Various fuel systems and fuel vapor purge systems may be used in accordance with the engine embodiments of the present description.

Controller 12 is shown in 2 as a conventional microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAP) from mass air flow sensor 100 coupled to throttle body 58; engine coolant temperature (ECT) from temperature sensor 112 coupled to cooling sleeve 114; profile ignition pickup signal (PIP) from Hall effect sensor 118 coupled to crankshaft 40; throttle position TP from throttle position sensor 120; absolute Manifold Pressure Signal MAP from sensor 122; indication of knock from knock sensor 182; and indication of absolute or relative ambient humidity from sensor 180. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In a one example, sensor 118, which is also used as an engine speed sensor, produces a predetermined number of equally spaced pulses every revolution of the crankshaft.

In this particular example, temperature Tcat1 of catalytic converter 70 and temperature Tcat2 of emission control device 72 (which can be a NOx trap) are inferred from engine operation as disclosed in U.S. Pat. No. 5,414,994, the specification of which is incorporated herein by reference. In an alternate embodiment, temperature Tcat1 is provided by temperature sensor 124 and temperature Tcat2 is provided by temperature sensor 126.

Continuing with FIG. 2, camshaft 130 of engine 10 is shown communicating with rocker arms 132 and 134 for actuating intake valves 52*a*, 52*b* and exhaust valve 54*a*. 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling as will be described later herein, the relative position of camshaft 130 to crankshaft 40 can be varied by hydraulic pressures in advance chamber 142 and retard chamber 144. By allowing high pressure hydraulic fluid to enter advance chamber 142, the relative relationship between camshaft 130 and crankshaft 40 is advanced. Thus, intake valves 52*a*, 52*b* and exhaust valves 54*a*, 54*b* open and close at a time earlier than normal relative to crankshaft 40. Similarly, by allowing high pressure hydraulic fluid to enter retard chamber 144, the relative relationship between camshaft 130 and crankshaft 40 is retarded. Thus, intake valves 52*a*, 52*b*, and exhaust valves 54*a*, 54*b* open and close at a time later than normal relative to crankshaft 40.

Teeth 138, being coupled to housing 136 and camshaft 130, allow for measurement of relative cam position via cam timing sensor 150 providing signal VCT to controller 12. Teeth 1, 2, 3, and 4 are preferably used for measurement of cam timing and are equally spaced (for example, in a V-8 dual bank engine, spaced 90 degrees apart from one another) while tooth 5 is preferably used for cylinder identification, as described later herein. In addition, controller 12 sends control signals (LACT, RACT) to conventional solenoid valves (not shown) to control the flow of hydraulic fluid either into advance chamber 142, retard chamber 144, or neither.

Relative cam timing is measured using the method described in U.S. Pat. No. 5,548,995, which is incorporated herein by reference. In general terms, the time, or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Other examples of variable cam timing systems are disclosed in U.S. Pat. Nos. 5,386,807; 6,053,138; 6,085,708; 5,002,023; 5,107,804; 5,172,659; 5,184,578; 5,361,735 and 5,497,738, the disclosures of which are hereby incorporated by this reference, in their entireties and for all purposes.

Sensor 160 may also provide an indication of oxygen concentration in the exhaust gas via signal 162, which provides controller 12 a voltage indicative of the O2 concentration. For example, sensor 160 can be a HEGO, UEGO, EGO, or other type of exhaust gas sensor. Also note that, as described above with regard to sensor 76, sensor 160 can correspond to various different sensors.

As described above, FIG. 2 merely shows one cylinder of a multi-cylinder engine, and that each cylinder has its own set of intake/exhaust valves, fuel injectors, spark plugs, etc. In addition, FIG. 2 shows but one example; many other engine configurations are possible. For example, instead of employing mechanical cams only, some valves may be actuated electromechanically or electrohydraulically. Furthermore, it may be desirable to employ a variety of combustion modes, including spark ignition, homogeneous charge compression ignition (HCCI), and/or HCCI with a spark assist. Moreover, it may be desirable from time to time to switch the combustion modes for one or more combustion cylinders. Accordingly, it will be desirable in some cases to exercise variable control over valve operation, so as to obtain the desired performance in a given combustion mode. Valve control variation (e.g., variation in timing, lift, etc.) may be achieved through cam profile switching, variable cam timing, electromechanical valve actuation (EVA), etc., for both intake and exhaust valves of the combustion cylinders.

Also, in the example embodiments described herein, the engine is coupled to a starter motor (not shown) for starting the engine. The starter motor is powered when the driver turns a key in the ignition switch on the steering column, for example. The starter is disengaged after engine start as evidence, for example, by engine 10 reaching a predetermined speed after a predetermined time. Further, in the disclosed embodiments, an exhaust gas recirculation (EGR) system routes a desired portion of exhaust gas from exhaust manifold 48 to intake manifold 44 via an EGR valve (not shown). Alternatively, a portion of combustion gases may be retained in the combustion chambers by controlling exhaust valve timing.

The engine 10 operates in various modes, including lean operation, rich operation, and "near stoichiometric" operation. "Near stoichiometric" operation refers to oscillatory operation around the stoichiometric air fuel ratio. Typically, this oscillatory operation is governed by feedback from exhaust gas oxygen sensors. In this near stoichiometric operating mode, the engine is operated within approximately one air-fuel ratio of the stoichiometric air-fuel ratio. This oscillatory operation is typically on the order of 1 Hz, but can vary faster and slower than 1 Hz. Further, the amplitude of the oscillations are typically within 1 a/f ratio of stoichiometry, but can be greater than 1 a/f ratio under various operating conditions. Note that this oscillation does not have to be symmetrical in amplitude or time. Further note that an air-fuel bias can be included, where the bias is adjusted slightly lean, or rich, of stoichiometry (e.g., within 1 a/f ratio of stoichiometry). Also note that this bias and the lean and rich oscillations can be governed by an estimate of the amount of oxygen stored in upstream and/or downstream three way catalysts.

Feedback air-fuel ratio control may be used for providing the near stoichiometric operation. Further, feedback from exhaust gas oxygen sensors can be used for controlling air-fuel ratio during lean and during rich operation. In particular, a switching type, heated exhaust gas oxygen sensor (HEGO) can be used for stoichiometric air-fuel ratio control by controlling fuel injected (or additional air via throttle or VCT) based on feedback from the HEGO sensor and the desired air-fuel ratio. Further, a UEGO sensor (which provides a substantially linear output versus exhaust air-fuel ratio) can be used for controlling air-fuel ratio during lean, rich, and stoichiometric operation. In this case, fuel injection (or additional air via throttle or VCT) is adjusted based on a desired air-fuel ratio and the air-fuel ratio from the sensor. Further still, individual cylinder air-fuel ratio control could be used, if desired.

As indicated above, it will often be desirable to employ variable cam timing. Advantages of variable cam timing may include improved emissions, fuel economy and power density. As discussed above, one method for providing variable cam timing includes a hydraulically-actuated rotatable coupling, which may also be referred to as a cam phaser. An exemplary variable cam timing phaser will now be described with reference to FIGS. 3–5.

Figure 3:
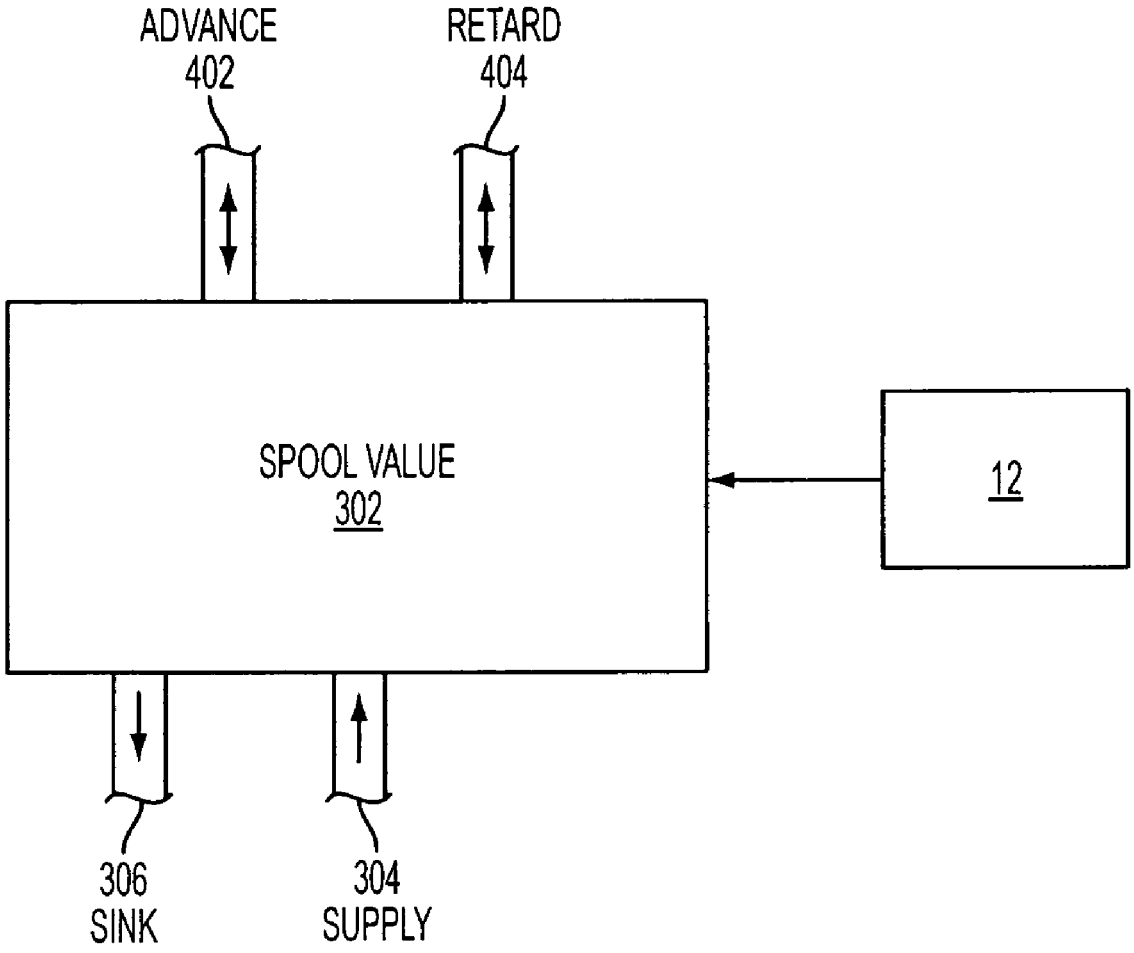
FIG. 3 schematically depicts a hydraulic valve that may be used in connection with a variable cam timing device of the present description.
Figure 4:
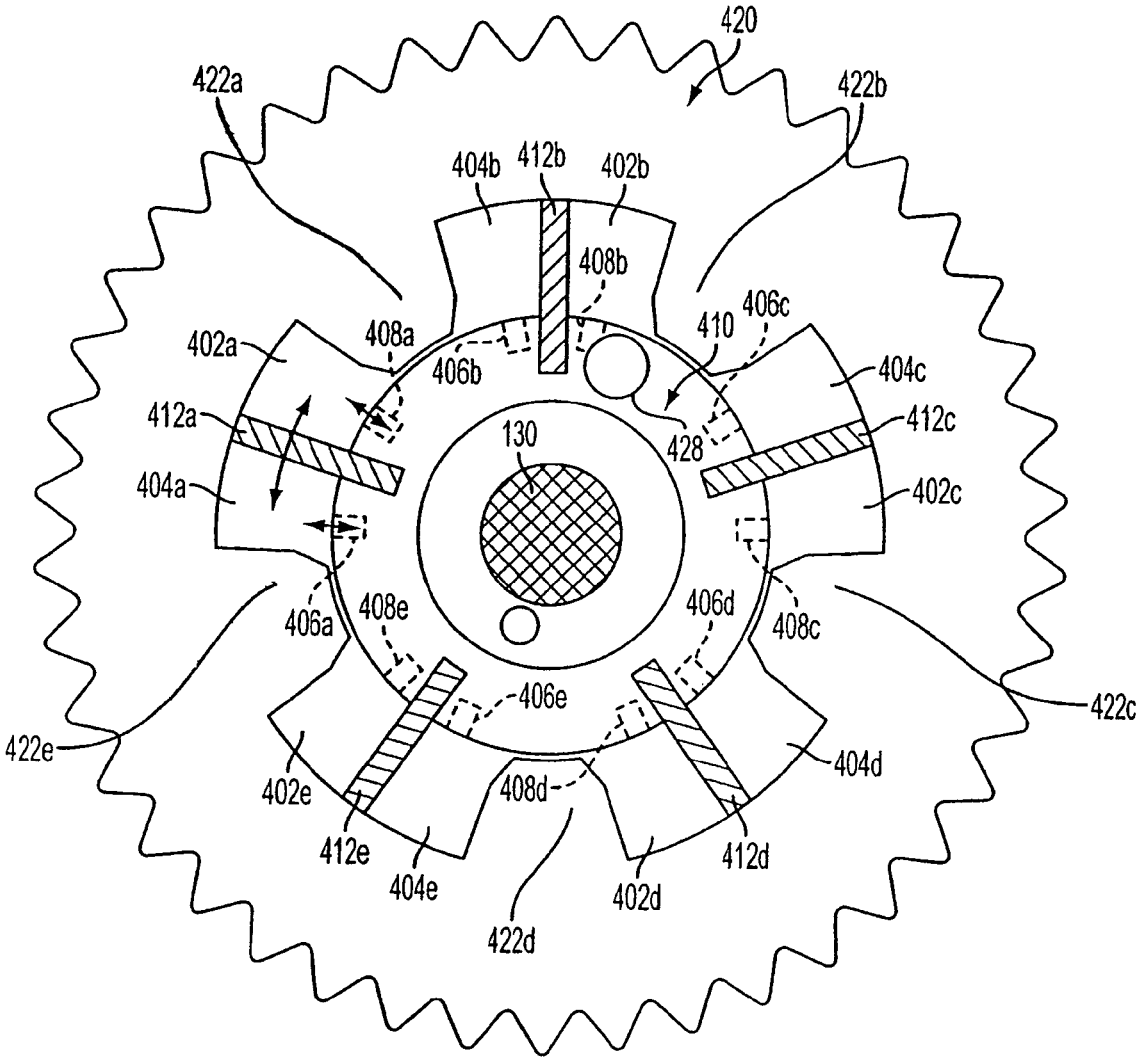
FIG. 4 is a plan view of a variable cam timing phaser according to the present description.
Figure 5:
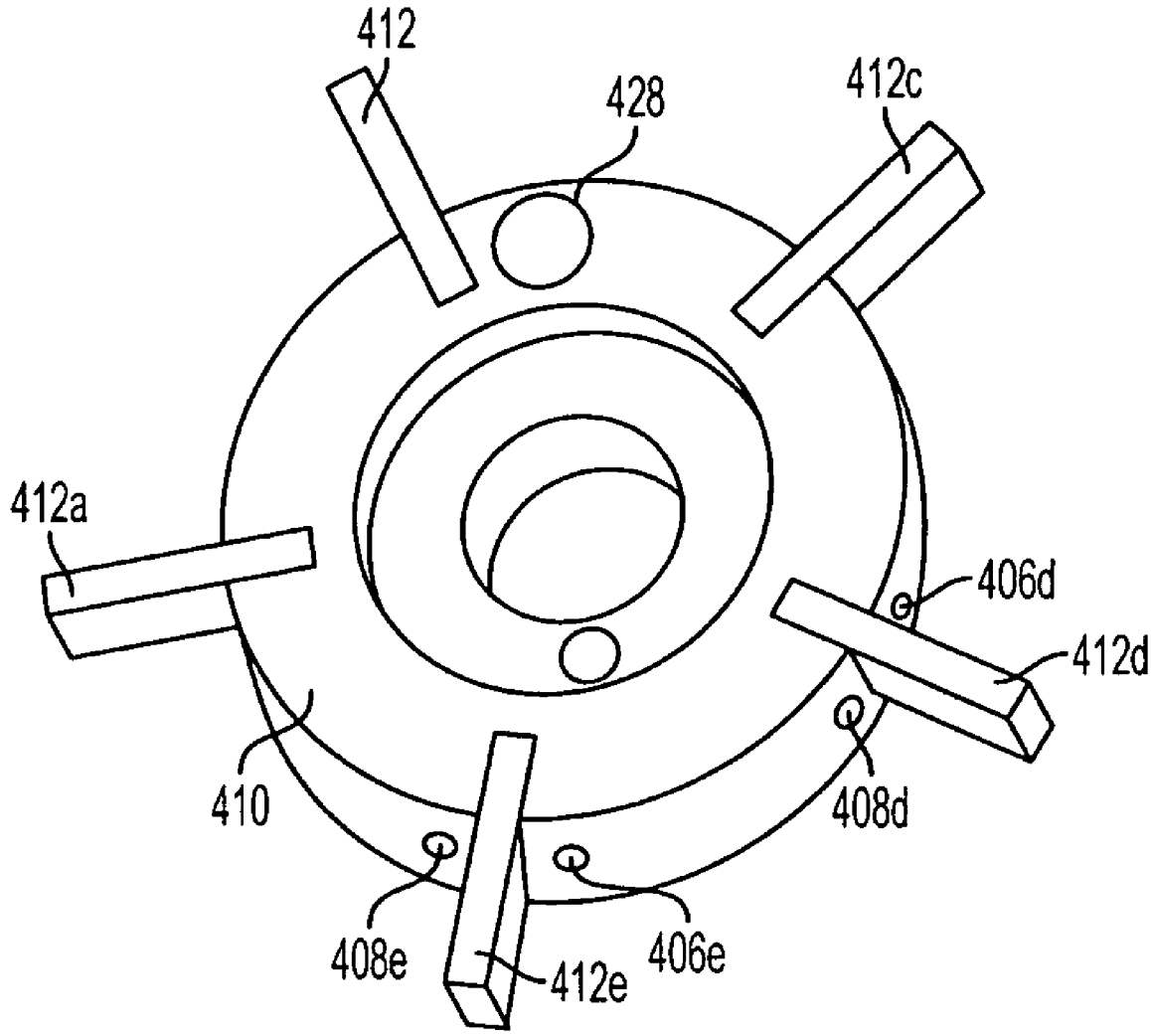
FIG. 5 is an isometric view of the rotor of the variable cam timing phaser of FIG. 4.

In certain example embodiments, a spool valve 302 (FIG. 3) is employed to control a hydraulic circuit or circuits that enable selective filling and draining of the advance chambers 402 (*a*–*e*) and retard chambers 404 (*a*–*e*) defined by rotor 410 and stator 420 (FIGS. 4 and 5). The resulting hydraulic forces operate to control the relative angle between the rotor and stator. Stator 420 is coupled via a timing belt, chain or other linkage (not shown) to crankshaft 40, and includes a plurality of inwardly-extending lobes 422 (*a*–*e*). Rotor 410 is coupled to camshaft 130, and includes a plurality of outwardly-extending lobes, or vanes 412 (*a*–*e*). The lobes of the rotor and stator interleave, as shown in FIG. 4, so that the advance chambers 402 and retard chambers 404 are defined on opposing sides of each rotor vane 412, between adjacent pairs of stator lobes 422.

As shown in FIG. 3, spool valve 302 typically is controlled in response to control signals received from controller 12. Typically, the control signals are applied to control movement of a solenoid or like device within the spool valve. Movement of the solenoid controls routing of hydraulic fluid, typically pressurized engine oil, through the spool valve. More particularly, the state of the spool valve may be controlled to selectively enable and disable hydraulic circuits between a relatively high pressure supply 304, a relatively low pressure sink 306, and the retard and advance chambers defined between the rotor and stator.

A plurality of orifices are defined in rotor 410, to enable selective fluid coupling of hydraulic supply 304 and hydraulic sink 306 (FIG. 3) to the advance and retard chambers defined between rotor 410 and stator 420. Specifically, as shown in FIGS. 4 and 5, for each retard chamber 404, an orifice 406 (*a–e*) is defined within the rotor so that the orifice is fluidly coupled with its associated retard chamber 404. Then, depending on the state of the spool valve, (1) fluid flows into the retard chamber from hydraulic supply 304, (2) fluid flows from the retard chamber to hydraulic sink 306, or (3) there is no fluid flow, and the relative rotational position of the rotor and stator is maintained. Similarly, on the opposing side of each rotor vane, an orifice 408 (*a–e*) is defined in the rotor for the advance chambers 402.

More particularly, in a first state, spool valve 302 couples advance chambers 402 with relatively high pressure hydraulic supply 304 (e.g., of engine oil) and retard chambers 404 with relatively low pressure hydraulic sink 306. While the spool valve is in this state, the relatively higher pressure of engine oil within the advance chambers causes a relative increase in volume of the advance chambers to the retard chambers. This produces a rotation of rotor 410 relative to stator 420 (counter-clockwise in FIG. 4). This advances the angular position of the camshaft relative to the crankshaft and thus advances cam timing. The advancing rotation continues until the rotor vane abuts against the stator, or until pressure is otherwise equalized on both sides of the rotor.

One way of equalizing the pressure and this fixing the rotor in place relative to the stator is to place the spool valve in a second, closed state. In this state, the fluid coupling between the advance/retard chambers and the supply/sink is sealed off. Hydraulic fluid is thus sealed into the advance and retard chambers with equalized pressure on opposing sides of the rotor vanes, which in turn maintains the phaser in a fixed angular position (e.g., to maintain a desired timing relationship between the crankshaft and camshaft).

To retard cam timing, spool valve 302 is placed in a third state, in which the spool valve couples advance chambers 402 with relatively low pressure hydraulic sink 306 and retard chambers 404 with relatively high pressure hydraulic supply 304. The resulting higher pressure within the retard chambers causes the rotor to rotate in the opposite direction, thereby delaying the relative timing between the camshaft and the crankshaft. As with the advancing direction, rotation in the retarding direction continues until forces/pressures equalize on opposing sides of the vane, e.g., until the spool valve is closed or the rotor vanes abut against the stator.

Additionally, the spool valve may be dithered, or rapidly oscillated between the above-described states, as desired. For example, it may at times be desirable to dither the valve to rapidly alternate between commanding an advance and a retard of cam timing. By rapidly dithering between retard and advance, the relative camshaft/crankshaft angle can be maintained while still supplying pressurized oil to the chambers to make up for hydraulic losses in the chambers (e.g., due to small amounts of oil escaping between sealed surfaces).

The exemplary cam phasers herein may also employ other methods to effect or maintain a desired relative angle between the rotor and stator. For example, a torsion assist device, such as a spring, may be employed to bias the cam phaser toward a particular position, and/or to provide a rotating force in the absence of sufficient oil pressure. In addition, a locking pin 428 may be employed to hold or otherwise maintain the rotor and stator in a desired relative angular position. Locking pin 428 may be used, for example, to maintain a desired start-up cam timing, or to maintain a desired timing during periods of low oil pressure.

Operation of a vane-type cam phaser such as that described herein can produce can be a source of noise. In some cases, the noise can be heard or otherwise perceived by occupants of the vehicle, and thus can be an undesirable source of noise, vibration and harshness (NVH). For example, when the timing rotor goes through a maximum retard or maximum advance shift, the vanes of the rotor can hit the stator with a large force. This resulting impulsive energy can be a source of noise. In addition, the locking pins used in certain VCT systems require a small amount of backlash, (typically 0.8 degrees), to ensure the pin will unlock. The VCT rotor can flutter within this backlash due to cam torsional effects and cause noise.

Figure 6:
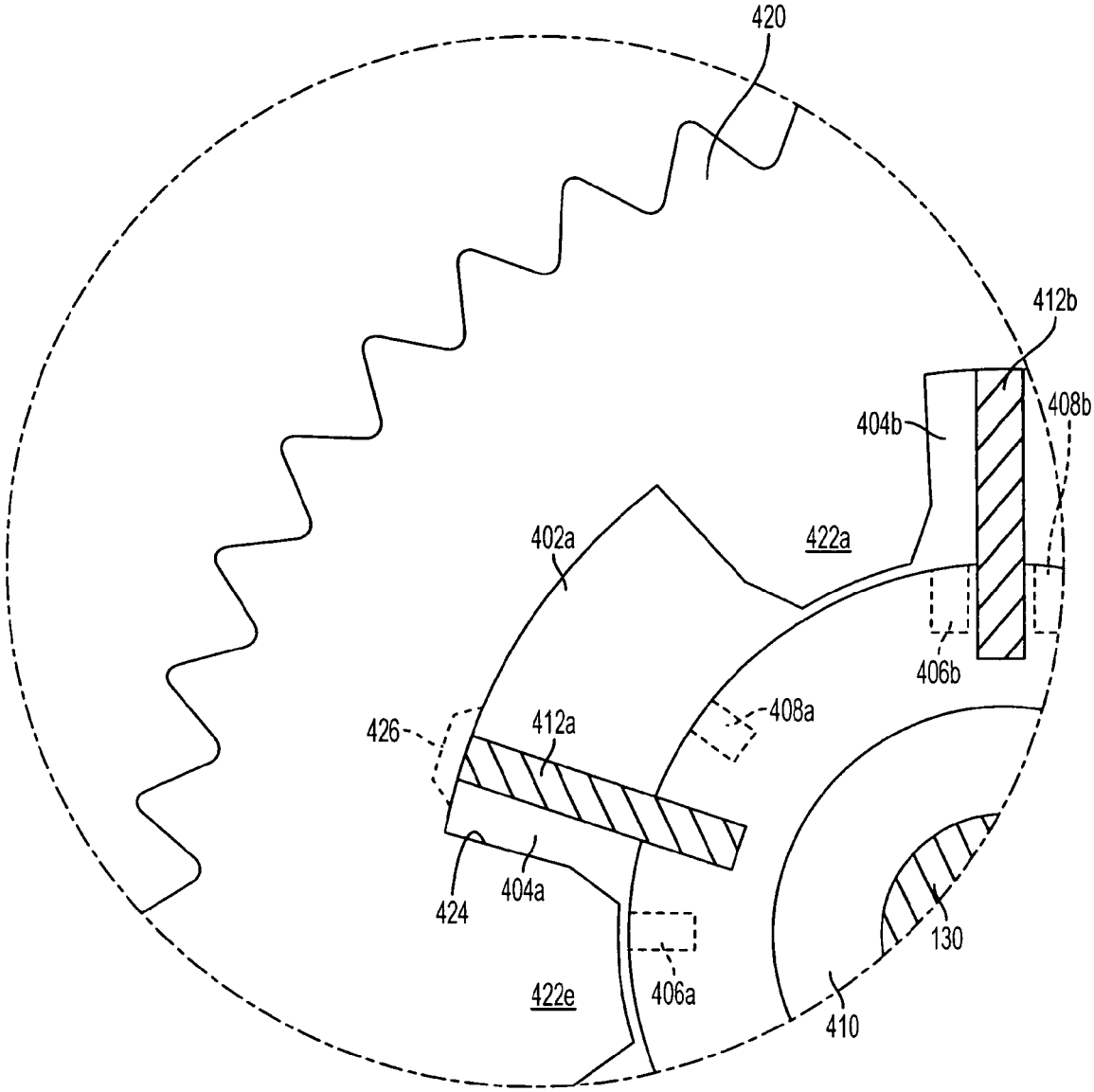
FIG. 6 is an enlarged partial view of the variable cam timing phaser of FIG. 4, showing the rotor rotated toward a fully advanced position.

Accordingly, the variable cam timing phaser of the present description may be provided with a viscous damping capability in order to reduce or eliminate the above-described noise, and thereby eliminate a source of potential operator dissatisfaction. In a first example, viscous damping is achieved via location of the fill/drain orifices of one or more of the retard or advance chambers. Referring to FIG. 6, rotor 410 is moving counter-clockwise relative to stator 420 as the cam timing is being advanced. Orifice 406*a* of retard chamber 404*a* is positioned so that the orifice becomes sealed off from retard chamber 404*a* while vane 412*a* is still spaced away from stator wall region 424. Thus, as rotor 410 approaches its maximum advanced position, the engine oil within the retard chamber is sealed within the chamber and prevented from flowing out orifice 406*a* to hydraulic sink 306. The resulting increase in pressure within the retard chamber stops or at least slows the rotor as it approaches wall region 424, thereby eliminating or reducing noise from impact between the rotor and stator. In the position shown in FIG. 6, the engine oil trapped in retard chamber 404*a* acts as a viscous NVH damper.

Prior to the rotor reaching the terminal position shown in FIG. 6 (e.g., when vane 412*a* is centered between stator lobes 422*e* and 422*a*), the relatively larger pressure differential is maintained between advance chamber 402*a* and retard chamber 404*a*, due to (1) the fluid coupling of advance chamber 402*a* with hydraulic supply 304 via orifice 408*a*; and (2) the fluid coupling of retard chamber 404*a* with hydraulic sink 306 via orifice 406*a*. This relatively larger pressure differential causes the rotor to move counter-clockwise. Then, as the rotor reaches the depicted position, the partial or complete blockage/sealing of orifice 406*a* causes retard chamber 404*a* to be fluidly decoupled from hydraulic sink 306. The trapped fluid remaining in the retard chamber then cushions the vane and minimizes or eliminates impact noise.

The complete or partial sealing can be employed for the fully advanced state (as shown in FIG. 6), the fully retarded state, or both. Specifically, as shown in FIG. 6, advance chamber orifice 408*a* is positioned so that the orifice will be completely or partially sealed by stator lobe 422*a* as the rotor reaches the fully retarded position (clockwise rotation).

Typically, less than all of the chamber orifices will be positioned so as to create the described sealing as the rotor approaches its maximum advanced or retarded position. For example, referring again to FIG. 6, in the depicted position of rotor 410, orifice 406*a* is positioned so that retard chamber is sealed off from the hydraulic circuit, thus providing the described cushion of engine oil in the retard chamber. Orifice 406*b*, however, is positioned to remain in fluid communication with retard chamber 404*b*. Accordingly, when spool valve 302 is controlled so as to retard cam timing, the position of orifice 406*b* enables pressurized engine oil from supply 304 to flow into retard chamber 406*b*. Referring to FIG. 4, orifices for two of the five retard chambers may be positioned to provide damping, while the orifices for the remaining three retard chambers would be positioned so as to preserve the hydraulic circuit between the retard chamber and spool valve even during maximum rotation of the rotor. This preservation of the hydraulic circuit allows the same orifice to be used when commanding movement of rotor in the opposite direction (i.e., to retard cam timing). Accordingly, upon movement away from the maximum advanced position, hydraulic fluid would be supplied initially from supply 304 primarily through three of the retard chamber orifices. Upon sufficient rotation, the remaining two orifices would become unblocked and the hydraulic flows through those orifices would be enabled.

Under certain conditions, the engine oil that is trapped to provide damping can become depleted over time. For example, when the rotor is locked in a base position (such as with a locking pin), cam torsional effects on the rotor vane can pump the trapped oil out of the chamber, thereby diminishing the desired damping effect. Accordingly, for timing chambers adapted to provide the described damping, an equalization passage or communication groove 426 may be defined. As in the example of FIG. 6, the passage typically is defined so as to provide fluid coupling between the chambers defined on opposing sides of a rotor vane only when damping is desired due to the rotor vane being close to a stator lobe (e.g., near the maximum advanced or retarded position). In these extreme/terminal positions, it is desirable to preserve the described damping effect. Thus, the rotor and/or stator are adapted so that the equalization passage is open or available. The passage allows the damping fluid to be replenished from the opposite side of the vane. For example, dithering of the spool valve can intermittently apply pressure within advance chamber 402*a*, with that pressure being equalized through passage 426 when vane 412*a* is in the depicted advanced position.

Accordingly, the phaser typically is configured so that, in a first position (e.g., rotor is centered), the equalization passageway is closed. In a second position, such as a terminal position when damping is desired, the equalization passageway is open. Typically, where damping is employed, the chamber orifice and equalization passageway are disposed or configured so that the partial or complete sealing of the chamber orifice (which produces the damping) and opening of the equalization passageway occur at approximately the same rotational position of the rotor, as shown in FIG. 6.

The invention claimed is:

1. A variable cam-timing phaser, comprising:

a stator having a plurality of inwardly-extending stator lobes;

a rotor having a plurality of outwardly-extending rotor lobes, the rotor being rotatably disposed within the stator so that the rotor lobes interleave with the stator lobes to form a first timing chamber and a second timing chamber between each of the stator lobes, where rotating the rotor in a first direction relative to the stator causes each of the first timing chambers to increase in volume and each of the second timing chambers to decrease in volume, and where rotating the rotor in a second opposite direction relative to the stator causes each of the second timing chambers to increase in volume and each of the first timing chambers to decrease in volume; and a plurality of hydraulic fluid orifices, one such orifice being associated with each of the first timing chambers for permitting hydraulic fluid to fill and drain from each of the first timing chambers, the orifices being positioned so that when the stator and rotor are in a first relative rotational position, each of the orifices is fluidly coupled with its associated first timing chamber, and when the stator and rotor are in a second relative rotational position, at least one of the orifices is sealed off from its associated first timing chamber and at least another of the orifices remains fluidly coupled with its associated first timing chamber.

2. The variable cam-timing phaser of claim 1, where the stator is configured to be coupled to an engine crankshaft via a timing belt or chain, and where the rotor is configured to be coupled to a camshaft.

3. The phaser of claim 2, further comprising an equalization passage defined in at least one of the stator and rotor, where when the stator and rotor are in the second relative rotational position, the equalization passage is open such that the equalization passage fluidly couples the first timing chamber having the sealed-off orifice with an adjacent one of the second timing chambers, the equalization passage being closed when the stator and rotor are in the first relative rotational position.

4. The phaser of claim 3, where the first timing chambers are retard timing chambers and the second timing chambers are advance timing chambers.

5. The phaser of claim 2, where when the stator and rotor are in the second relative rotational position, at least one other of the orifices remains fluidly coupled with its associated first timing chamber.

6. The phaser of claim 2, where the first timing chambers are retard timing chambers and the second timing chambers are advance timing chambers.

7. The phaser of claim 2, where the first timing chambers are advance timing chambers and the second timing chambers are retard timing chambers.

8. A variable cam-timing phaser, comprising:

a stator having a plurality of inwardly-extending stator lobes;

a rotor having a plurality of outwardly-extending rotor lobes, the rotor being rotatably disposed within the stator so that the rotor lobes interleave with the stator lobes to form a first timing chamber and a second timing chamber between each of the stator lobes; and a valve, where the phaser is configured so that, upon operation of the valve to selectively couple the second timing chambers to a hydraulic fluid supply and the first timing chambers to a hydraulic fluid sink, the rotor is caused to rotate toward a terminal position, in which at least one of the first timing chambers is at least partially sealed off from the hydraulic fluid sink, thereby leaving a viscous damping space between the rotor and stator and producing a tendency toward pressure equalization between the first timing chambers and the second timing chambers.

9. The phaser of claim 8, where each of the first and second timing chambers includes an orifice configured to fluidly couple the timing chamber to the hydraulic fluid supply or the hydraulic fluid sink, depending on operation of the spool valve, and where rotating the rotor into the terminal position causes at least one of the orifices to become at least partially sealed off from its timing chamber.

10. The phaser of claim 9, where when the rotor is in the terminal position, the rotor lobes are spaced apart from the stator lobes, so as to accommodate an NVH-damping volume of hydraulic fluid between the rotor lobes and the stator lobes.

11. The phase of claim 9, where at least one of the rotor and the stator is configured so that when the rotor is in the terminal position, an equalization passage is defined between the timing chamber having the seated-off orifice and an adjacent one of the timing chambers.

12. The phaser of claim 9, where when the rotor is rotated into the terminal position, at least one other of the orifices remains fluidly coupled with its timing chamber.

13. The phaser of claim 8, where the first timing chambers are advance timing chambers and the second timing chambers are retard timing chambers.

14. The phaser of claim 8, where the first timing chambers are retard timing chambers and the second timing chambers are advance timing chambers.

15. A variable cam-timing phaser, comprising:

a stator having a plurality of inwardly-extending stator lobes;

a rotor having a plurality of outwardly-extending rotor lobes, the rotor being rotatably disposed within the stator so that the rotor lobes interleave with the stator lobes to form a first timing chamber and a second timing chamber between each of the stator lobes; and where the stator and rotor are configured so that one of the first timing chambers and one of the second timing chambers are fluidly decoupled when the rotor is in a first position relative to the stator and fluidly coupled when the rotor is in a second position relative to the stator.

16. The phaser of claim 15, further comprising a hydraulic valve, where the phaser is configured so that, upon operation of the valve to selectively couple the second timing chambers to a hydraulic fluid supply and the first timing chambers to a hydraulic fluid sink, the rotor is caused to rotate toward a terminal position, in which at least one of the first timing chambers is at least partially sealed off from the hydraulic fluid sink, thereby producing a tendency toward pressure equalization between the first timing chambers and the second timing chambers.

17. The phaser of claim 16, where the first timing chambers are advance timing chambers and the second timing chambers are retard timing chambers.

18. The phaser of claim 16, where the first timing chambers are retard timing chambers and the second timing chambers are advance timing chambers.

* * * * *